United States Patent [19]

Tygat et al.

[11] Patent Number: 4,765,958

[45] Date of Patent: Aug. 23, 1988

[54] PROCESS FOR INHIBITING THE CORROSION OF A MASS OF METAL IN CONTACT WITH AN ACID BATH CONTAINING FERRIC IONS

[75] Inventors: Daniel Tygat; Pierre Lefevre; Dominique Balthasart, all of Brussels, Belgium

[73] Assignee: Solvay & Cie, S.A., Brussels, Belgium

[21] Appl. No.: 721,935

[22] Filed: Apr. 9, 1985

[30] Foreign Application Priority Data

Apr. 16, 1984 [FR] France ..... 84 06098

[51] Int. Cl.[4] ..... C23F 11/04

[52] U.S. Cl. ..... 422/12; 134/3; 134/10; 422/7; 210/490

[58] Field of Search ..... 422/7, 12; 210/696, 210/490; 134/3, 10

[56] References Cited

FOREIGN PATENT DOCUMENTS 1425820 3/1965 France .

OTHER PUBLICATIONS

Chemical Abstract 83(14): 119514z, 10-6-1975.

Chemical Abstract 86(49): 191999r, 1977.

Condensed Chemical Dictionary, 10th Edition, 1981, pp. 194-195.

"Synergistic Inhibition of Ferric Ion Corrosion During Chemical Cleaning of Metal Surfaces", Streicher, Michael; Corrosion-NACE, vol. 28, No. 4, Apr. 1972, 143-148.

*Primary Examiner*—Barry S. Richman

*Assistant Examiner*—William R. Johnson

*Attorney, Agent, or Firm*—Spencer & Frank

[57] ABSTRACT

Process for inhibiting the corrosion of a mass of metal (2) in contact with an acid bath (3) containing ferric ions, according to which at least a part of the bath (3) is circulated through a stack of felts (10) made of carbon or graphite, alternating with perforated plates made of iron or an iron alloy (9). The process applies to the pickling of metallurgical products made of steel in hydrochloric acid baths.

9 Claims, 4 Drawing Sheets

PROCESS FOR INHIBITING THE CORROSION OF A MASS OF METAL IN CONTACT WITH AN ACID BATH CONTAINING FERRIC IONS

BACKGROUND OF THE INVENTION

1. Field of the Invention

The present invention relates to a process for inhibiting the corrosion of masses of metal in contact with acid baths containing ferric ions, for example an industrial plant subjected to a descaling operation, or metallurgical products subject to a pickling operation.

2. Description of the Background

It is known to treat metal plants with acid baths, especially for the purpose of pickling or descaling them. These pickling and descaling methods are widely employed in industry, where they are used particularly for descaling steel boilers and for removing encrustation from crystallisation reactors such as steel or cast iron columns employed for the crystallisation of sodium bicarbonate in the ammonia soda manufacturing process.

It is common practice moreover, in the conversion of metallurgical products, to subject the latter to. a final pickling operation in an acid bath. This is the case mainly with rolling products made of ordinary steel, and more particularly with those produced by cold rolling such as strips and drawn wires.

It is general practice to incorporate corrosion inhibitors in the baths. Corrosion inhibitors which are ordinarily employed for this purpose are alkylpyridinium chlorides, hexamethylenetetramine and organic compounds containing sulphonium groups. However, it has been observed in practice that, despite the presence of corrosion inhibitors in the acid baths, the latter nevertheless cause a rapid corrosion of the masses of metal which are treated. This corrosion may be attributed to the presence of oxidising agents in the bath, chiefly ferric ions. To overcome this disadvantage it has already been recommended to add reducing agents to the bath, for example stannous chloride, in addition to the corrosion inhibitors. The use of reducing agents in the bath is generally costly, particularly in the case of baths which are not deaerated, because a significant loss of reducing agents is then recorded, due to their premature consumption by the oxygen in the bath, this consumption being proportionately higher the higher the temperature. Furthermore, this is followed by an increase in bath contamination by reducing agents some of which, in particular stannous ions, are generally deemed to be ecologically dangerous, especially when the residual baths are discharged into lakes or water courses.

SUMMARY OF THE INVENTION

The invention aims to remedy the abovementioned disadvantages by providing a process for inhibiting the corrosion of masses of metal in contact with acid baths containing ferric ions, which is reliable, economical and environmentally inoffensive.

The invention is consequently concerned with a process for inhibiting the corrosion of a mass of metal in contact with an acid bath containing ferric ions; according to the invention at least a part of the bath is circulated through a stack of carbon or graphite felts, alternating with solid bodies made of iron or an iron alloy.

DESCRIPTION OF THE INVENTION

The process according to the invention applies to any acid bath containing ferric ions, which is capable of giving rise to an electrochemical oxidation of the mass of metal under the conditions of use of the bath. The ferric ions present in the bath can originate from very diverse sources such as, for example, from oxidised surface layers of the mass of metal, from corrosion of the bath handling circuit, from scale on the surface of the mass of metal, and from impurities present in the acid bath; in the case of aqueous acid baths, ferric ions can occasionally be contributed by the water employed to prepare the bath.

In the process according to the invention it is obviously appropriate to avoid the coupling of the mass of metal treated in the bath with the stack.

Various bath treatment methods may be employed in the stack. According to a first method of treatment, a portion of the bath is withdrawn at regular intervals and is circulated through the stack for a predetermined time which is sufficient to reduce at least a part of the ferric ions which it contains; the portion is then returned to the bath. According to a second method of treatment, which is preferred, the whole bath is circulated through the stack, at a flow rate regulated so that, at the outlet of the stack, its ferric ion content will have fallen below a preset value. In this preferred method of treatment circulation of the bath through the stack may be carried out at regular intervals or continuously.

The treatment of the bath in the stack is generally controlled so that the residual quantity of ferric ions in the bath in contact with the mass of metal does not exceed 300 mg/l preferably 200 mg/l Residual contents not exceeding 150 mg/l are recommended, particularly those between 1 and 100 mg/l.

In an advantageous embodiment of the process according to the invention a stack is employed in which the felts are made of fibres the diameter of which does not exceed 25 microns, preferably 15 microns. It is preferred to employ stacks of mild steel bodies and felts made of non-graphitic carbon, the fibre diameter of which is between 8 and 12 microns.

The solid bodies in the stack may have any profiles which permit a large area of contact with the felts. In a particular embodiment of the invention use is made of a stack in which the iron or iron alloy solid bodies are plates which alternate with the carbon felts or graphite felts.

In a preferred embodiment of the process according to the invention use is made of a stack in which the solid bodies are perforated plates and the bath is circulated through the stack in a direction transverse to the plates and the felts. In the case of major plants employing large bath volumes it may be advantageous to make use of several stacks arranged in parallel in the direction of circulation of the bath.

The process according to the invention also applies to the acid baths containing a corrosion inhibitor. The latter may be for example, an alkylpyridinium chloride which is advantageously chosen from those alkane derivatives containing from 10 to 18 carbon atoms. In the case of hydrochloric acid baths, use can be made, for example, of cetyl-, myristyl- or laurylpyridinium chloride, in a quantity set between 0.5 and 5000 mg per kg of bath, preferably between 2 and 500 mg/kg. Other examples of corrosion inhibitors which can be employed in the baths treated using the process according to the invention are hexamethylenetetramine and formalin.

The process according to the invention applies to any mass of metal treated in an acid bath containing ferric ions which is capable of attacking the mass of metal. It applies particularly to masses of metal containing iron, chromium, zinc, cobalt, nickel or an alloy containing at least one of these metals. It has an application which is of special interest in the case of masses of metal treated with aqueous baths of an inorganic acid containing ferric ions. It is particularly applicable to the descaling, by means of such baths, of nickel or nickel alloy evaporators employed to crystallise sodium chloride from caustic brines produced by electrolysis of a sodium chloride brine in a permeable-diaphragm electrolysis cell. Other examples of application are the descaling of the cooling zone of the steel or cast iron columns employed for the crystallisation of sodium bicarbonate in the ammonia soda manufacturing process, the removal of calcium carbonate scale from steel boilers, the handling of inorganic acids in aqueous solution in pipework or tanks made of steel or cast iron, the pickling of metallurgical products such as sheets, rods, joists or rails made of ordinary steel, and especially the pickling of cold-rolled products intended for a galvanising treatment such as strips and drawn wires. The acid bath in these various applications may be, for example, an aqueous solution of sulphuric acid or hydrochloric acid. Aqueous solutions containing from 0.01 to 6 moles of hydrochloric acid per litre are generally suitable.

The advantage of the invention will become apparent from the following description of some examples of application, with reference to the attached drawings.

BRIEF DESCRIPTION OF THE DRAWINGS

In these figures the same reference symbols denote identical elements.

Figure 1:
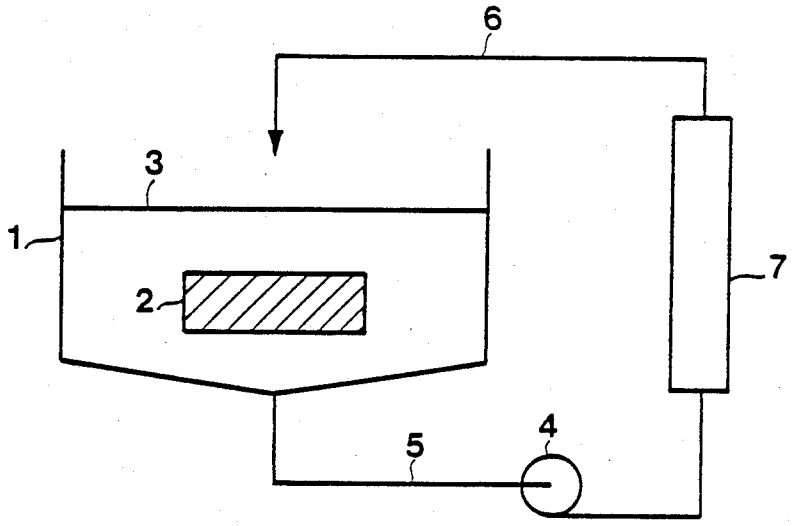
FIG. 1 is a diagram of a plant employing a particular embodiment of the process according to the invention.

The plant shown diagrammatically in FIG. 1 incorporates a pickling tank 1 containing a mass of ordinary steel or cast iron 2 to be pickled. The latter consists, for example, of a stack of coils of drawn wire or of strips. The pickling is provided by means of a bath 3 consisting of a standard solution of hydrochloric acid.

Figure 2:
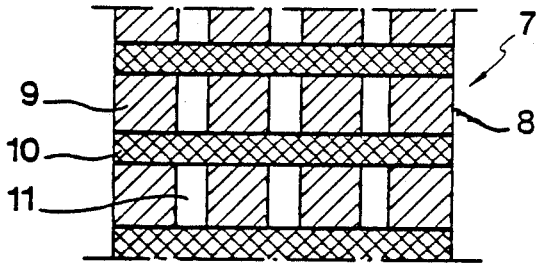
FIG. 2 shows a detail of the plant in FIG. 1, on a larger scale and in vertical cross-section.

The pickling tank is connected by means of a pump 4 and pipework 5 and 6 to a treatment cell 7. The latter is formed (FIG. 2) by a vertical tubular chamber 8 containing a stack of horizontal perforated steel discs 9, alternating with horizontal felts 10 made of non-graphitic carbon fibres. The discs 9 are pierced with tubular vertical perforations 11.

During the pickling of the mass of metal 2 in the bath 3, ferric ions are released continuously in the bath 3. According to the invention, the bath 3 in the tank 1 is circulated through the cell 7, via the pipework 5 and 6 and the pump 4. Circulation of the bath 3 through the cell 7 may be carried out periodically or continuously. In the cell 7 the bath circulates through the perforations 11 in contact with the discs 9 and through the felts 10, and the ferric ions are reduced to ferrous ions. By suitably setting the flow rate of the bath 3 through the cell 7 it is possible to compensate for the quantity of ferric ions which are released in the bath 3, in the tank 1, by a reduction of an equivalent quantity of ferric ions in the cell 7.

The following examples of application will demonstrate the advantage of the process according to the invention.

EXAMPLES

In these examples, use has been made of a 10 l volume of a four times normal aqueous solution of hydrochloric acid containing 10 g of ferric ions per litre, and it has been passed continuously through a stack of perforated metal discs, the cross-sectional area of each disc being 20 $cm^2$. The change, as a function of time, in the ferric ion concentration in the bath was measured. Use was made for this purpose of an electrochemical measurement cell incorporating a spinning platinum electrode and a fixed platinum counter-electrode, which were immersed in the hydrochloric acid bath, and a calomel reference electrode saturated with KCl; using a constant-voltage circuit, the spinning electrode was kept at a constant voltage of −150 mV relative to the reference electrode and the intensity of the electric current in the measurement cell was measured, the former being substantially proportional to the ferric ion concentration.

Figure 3:
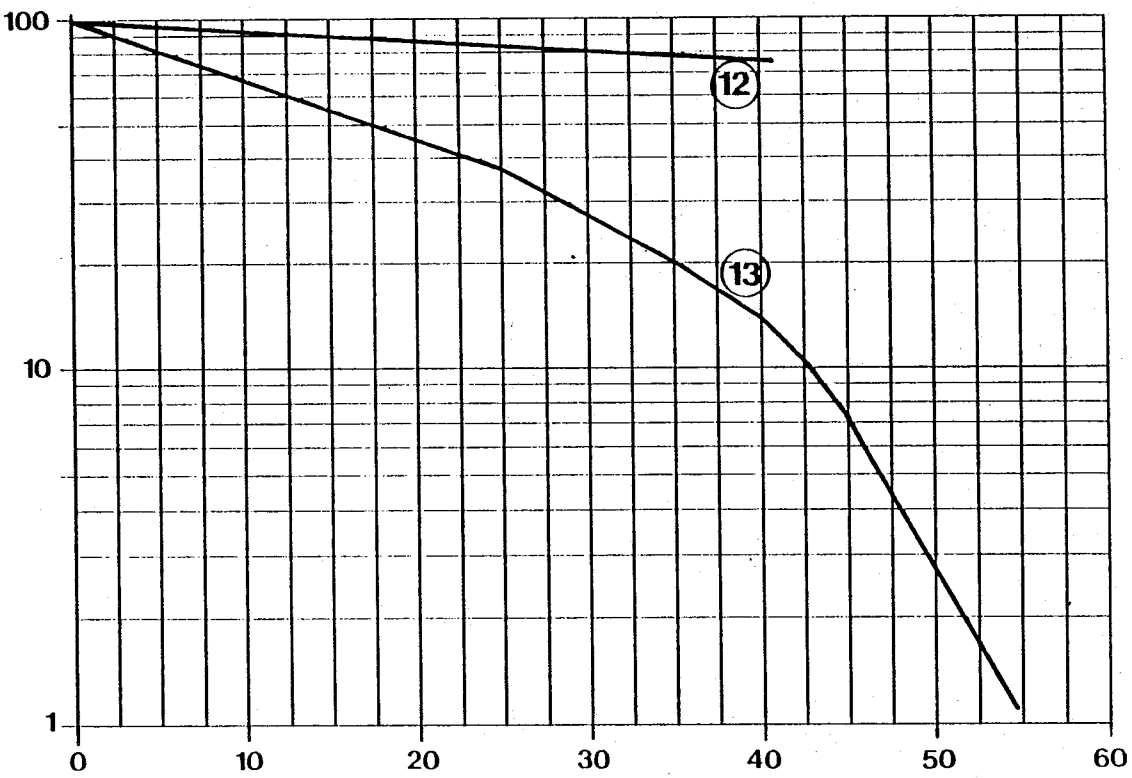
FIGS. 3 to 5 are graphs reproducing test results.
Figure 4:
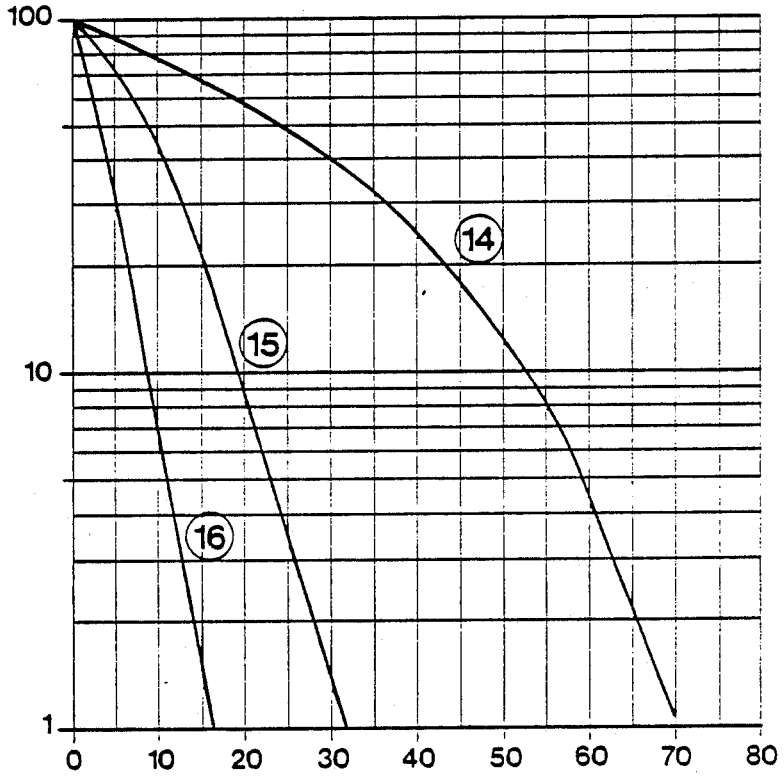
Figure 5:
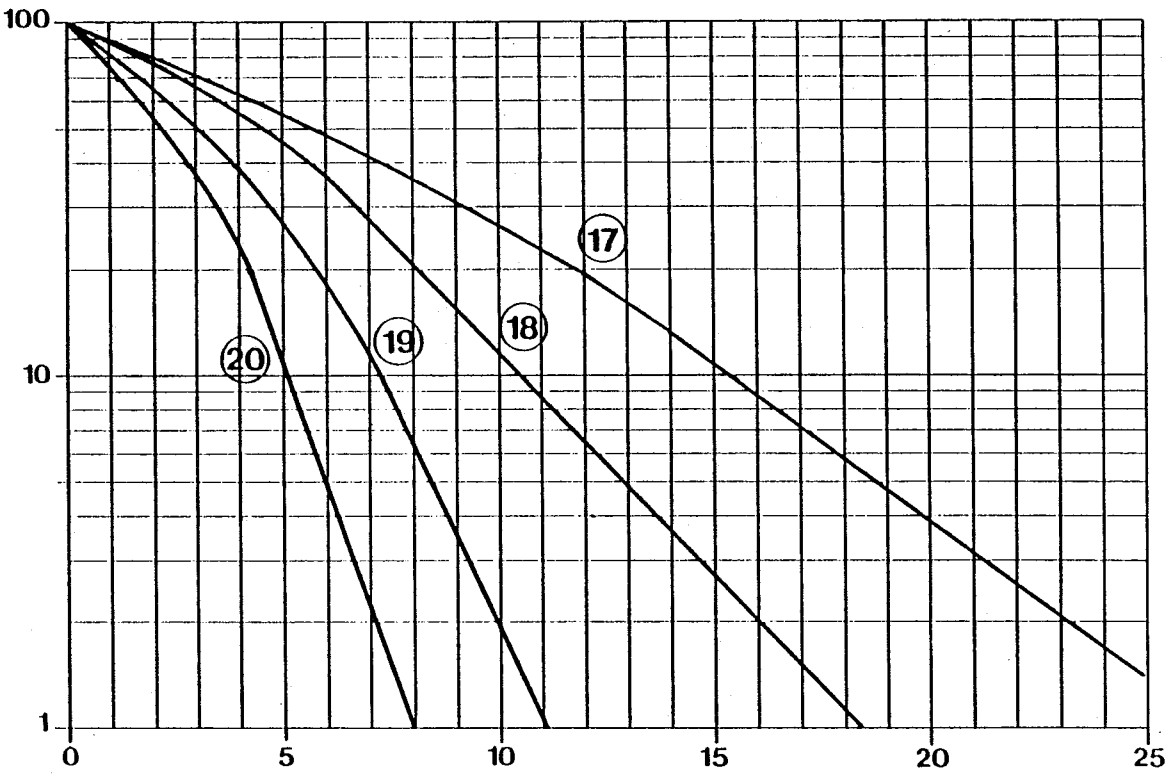

In the graphs in FIGS. 3 to 5, the abscissa scale refers to time, in minutes, and the ordinate scale refers to the ferric ion concentration in the bath, expressed in g/l.

EXAMPLE 1

(reference example)

The stack consisted of thirteen cast iron discs alternating with polyvinyl chloride rings.

The rate of flow of the solution through the stack was 150 l/h. The test results are illustrated by curve (12) in the graph in FIG. 3.

EXAMPLE 2

(according to the invention)

All of the operating conditions in the test of Example 1 were repeated, the stack of cast iron discs therein being replaced by a stack of thirteen perforated discs made of cast iron alternating with twelve graphite felts. The test results are embodied in curve (13) in the graph in FIG. 3. It can be seen that after 55 minutes of testing the concentration of ferric ions in the bath falls below 1% of its initial value.

EXAMPLES 3, 4 and 5

(according to the invention)

In each of these examples use was made of a stack of perforated steel discs (20 $cm^2$ in area) alternating with graphite felts. The number of graphite felts was, respectively, 6 in Example 3 and 12 in Example 4. In Example 5 use was made of two stacks of 13 discs (and 12 felts), the two stacks being fitted in parallel in the hydrochloric acid solution circuit. The rate of flow of the solution was 200 l/h in each test.

The test results are illustrated in the graph in FIG. 4, where curves (14), (15) and (16) relate respectively to the tests in Examples 3, 4 and 5. From these, it can be seen that the number of discs employed in the electrochemical cell has a direct effect on corrosion inhibition; in the case of Example 5, the residual ferric ion concentration falls below 1% of its initial value already after 17 minutes of treatment.

EXAMPLES 6, 7 and 8

(according to the invention)

In each of these examples use was made of a stack of 13 steel discs (and 12 non-graphitic carbon felts), and the rate of flow of the solution through the stacks was varied: 150 l/h in Example 6, 200 l/h in Example 7 and 500 l/h in Example 8. The test results are illustrated in the graph in FIG. 5, where curves (17), (18) and (19) refer to Examples 6, 7 and 8 respectively. From these it can be seen that, all else being equal, at a flow rate of 500 l/h, the residual ferric ion concentration in the bath falls below 1% of its starting value already after 11 minutes of treatment.

EXAMPLE 9

(according to the invention)

The conditions of Example 8 were repeated, with the use of two identical stacks (13 steel discs and twelve carbon felts) arranged in parallel in the solution circuit. The test results are illustrated by curve (20) in the graph in FIG. 5. From this it can be seen that 8 minutes suffice to change the ferric ion content of the bath from 10 g/l to 0.1 g/l.

A comparison of the results of Examples 2 to 9 (according to the invention) with those of Example 1 (reference test) makes it immediately apparent that the process according to the invention makes it possible to obtain rapid and efficient inhibition of the corrosion, the latter being proportional to the residual ferric ion concentration in the bath.

We claim:

1. A process for inhibiting the corrosion of a mass of metal in contact with an acid bath containing ferric ions, comprising circulating at least a part of the acid bath through a treatment chamber comprising alternating layers of (A) a fibrous member selected from the group consisting of non-graphitic carbon and graphite and (B) a member selected from the group consisting of iron and an iron alloy.

2. The process according to claim 1, wherein the fibre diameter of the fibrous non-graphitic carbon or graphite is equal to at most 25 microns.

3. The process according to claim 1, wherein (A) is a non-graphitic carbon and (B) is a mild steel alloy.

4. The process according to claim 1, wherein the bath is an aqueous bath of hydrochloric acid.

5. The process according to claim 1, wherein the circulation of the bath through the layers is set so as to maintain a ferric ion content equal to at most 150 mg/l in the bath which is in contact with the mass of metal.

6. The process according to claim 1, wherein each iron or iron alloy layer is in the shape of a plate.

7. The process according to claim 6, wherein each plate is perforated, and the bath is circulated through the alternating layers transversely to each plate and to each fibrous non-graphitic carbon or graphite layer.

8. The process according to claim 1, wherein the mass of metal is a member of the group consisting of chromium, zinc, iron, cobalt, nickel and an alloy containing at least one of these metals.

9. The process according to claim 8, wherein the mass of metal is a member of the group consisting of steel and cast iron.

* * * * *

UNITED STATES PATENT AND TRADEMARK OFFICE

CERTIFICATE OF CORRECTION

PATENT NO. : 4,765,958

DATED : August 23, 1988

INVENTOR(S) : Daniel Tytgat et al.

It is certified that error appears in the above-identified patent and that said Letters Patent is hereby corrected as shown below: Title page:

IN THE HEADING, Item [75] should read:

Inventors: Daniel Tytgat; Pierre Lefevre; Dominique Balthasart, all of Brussels, Belgium Item [19] "Tygat" should read -- Tytgat --.

Signed and Sealed this

Tenth Day of January, 1989

*Attest:*

*Attesting Officer*

DONALD J. QUIGG

*Commissioner of Patents and Trademarks*